US009499298B2

(12) United States Patent
Matthews et al.

(10) Patent No.: US 9,499,298 B2
(45) Date of Patent: Nov. 22, 2016

(54) PACKAGING CONTAINER FOR CAR ACCESSORIES

(71) Applicant: Who-Rae Australia, LLC, Compton, CA (US)

(72) Inventors: Giles Frederick Matthews, Hawthorn (AU); Elizabeth Helen Christmas, Pascoe Vale (AU); Lorrin Megan Windahl, Spotswood (AU)

(73) Assignee: Who-Rae Australia, LLC, Compton, CA (US)

( * ) Notice: Subject to any disclaimer, the term of this patent is extended or adjusted under 35 U.S.C. 154(b) by 71 days.

(21) Appl. No.: 14/518,122

(22) Filed: Oct. 20, 2014

(65) Prior Publication Data

US 2016/0023799 A1 Jan. 28, 2016

(30) Foreign Application Priority Data

Jul. 22, 2014 (AU) ..... 2014902828

(51) Int. Cl.

| | |
|---|---|
| ***B65D 6/24*** | (2006.01) |
| ***B65D 6/00*** | (2006.01) |
| ***B65D 8/00*** | (2006.01) |
| ***B65D 5/50*** | (2006.01) |

(52) U.S. Cl.

CPC ..... *B65D 11/00* (2013.01); *B65D 5/5097* (2013.01); *B65D 15/22* (2013.01); *B65D 2585/6882* (2013.01)

(58) Field of Classification Search

CPC .. B65D 11/1866; B65D 11/1893; B65D 5/12

USPC ..... 206/756, 758, 764, 765, 736, 775, 461, 206/462, 464, 465, 477, 495, 223, 577, 303, 206/326, 335, 735, 738, 449, 494; 229/935, 229/164

See application file for complete search history.

(56) References Cited

U.S. PATENT DOCUMENTS

| | | | | | |
|---|---|---|---|---|---|
| 321,903 | A * | 7/1885 | Krueger | B65D 5/38 | 206/290 |
| 1,711,877 | A * | 5/1929 | Drehmann | A47F 5/112 | 206/464 |
| 3,248,038 | A * | 4/1966 | Hennessey | B65D 5/3642 | 229/117.07 |
| 3,913,774 | A * | 10/1975 | Vajtay | B65D 15/08 | 220/315 |
| 2014/0116912 | A1* | 5/2014 | Brown | B65D 57/00 | 206/494 |

* cited by examiner

*Primary Examiner* — Stephen Castellano
(74) *Attorney, Agent, or Firm* — Wood Herron & Evans LLP

(57) ABSTRACT

A packaging container for a product including: a bottom tray including a base wall and a tray wall extending around the periphery of the base wall; a sleeve member supported on the bottom tray and extending along the periphery of the base wall such that the bottom tray and sleeve member together define a volume having an upper opening for accommodating the product, the sleeve member having a lower edge portion secured to the base wall by a securing arrangement; wherein the securing arrangement includes at least one aperture provided in the lower edge portion of the sleeve member, at least one clip member located along an inner face of the tray wall, the clip member including a shoulder for engaging a respective said aperture, and at least one abutment member located adjacent the clip member for abutting the lower edge portion of the sleeve member and maintaining the lower edge portion in an engaged position with the clip member.

15 Claims, 3 Drawing Sheets

PACKAGING CONTAINER FOR CAR ACCESSORIES

FIELD OF THE INVENTION

The present invention is generally directed to packaging for retail goods, and in particular to packaging for goods displayed at retail outlets. While the present invention will be described with respect to its application for packaging products such as car seat covers, it is to be appreciated that the invention is not restricted to this application and that other applications are also envisaged.

BACKGROUND OF THE INVENTION

Car seat covers are typically sold in Australia in flat packs where the car seat cover is folded into a flat configuration and inserted into a generally clear plastic sleeve. A cardboard insert may also be included within the sleeve printed with details of the car seat cover. The sleeve may also include a hanging or other hanging means to allow the flat pack to be hung up for display in the shop. In the United States, it is more common for car seat covers to be sold while packaged within a free standing cardboard carton.

A problem associated with existing packs, regardless of whether it is a flat pack or carton, is that it is difficult or not possible to touch the fabric of the car seat cover. This can lead to customers opening the pack while in the shop to gain a better view and feel of the car seat cover. This is undesirable because the car seat cover needs to be refolded and placed back into the opened pack by the retailer if the customer decides not to purchase the product. The resultant repackaged pack will most likely show signs of having previously been opened, and would therefore be less desirable for another customer to purchase.

Other more general problems associated with flat packaging is that it is more difficult to display such products within the shop environment. Also, it is relatively easy to shoplift a flat packaged product as it can be easily secreted within a person's bag or under their clothing.

SUMMARY OF THE INVENTION

It is therefore an object of the present invention to overcome one or more of the problems associated with such known packaging.

With this in mind, the present invention provides a packaging container for a product including: a bottom tray including a base wall and a tray wall extending around the periphery of the base wall; a sleeve member supported on the bottom tray and extending along the periphery of the base wall such that the bottom tray and sleeve member together define a volume having an upper opening for accommodating the product, the sleeve member having a lower edge portion secured to the base wall by a securing arrangement; wherein the securing arrangement includes at least one aperture provided in the lower edge portion of the sleeve member, at least one clip member located along an inner face of the tray wall, the clip member including a shoulder for engaging a respective said aperture, and at least one abutment member located adjacent the clip member for abutting the lower edge portion of the sleeve member and maintaining the lower edge portion in an engaged position with the clip member.

A plurality of the clip members can be spaced along the inner face of the tray wall for respectively engaging a plurality of said apertures provided and spaced along the lower edge portion of the sleeve member. A plurality of abutment members may also be provided adjacent each said clip member. The clip members may preferably be formed as part of the tray wall. The abutment members may preferably be formed as part of the base wall and may extend upwardly therefrom. Each abutment member may have an upper free end having an inclined surface facing the tray wall for urging the lower edge portion of the sleeve member towards the tray wall. One or more of the abutment members may being longer to thereby extend beyond an upper edge of the tray wall. The higher abutment members help to direct the lower edge portion to the correct location adjacent the tray wall when the sleeve member is being initially installed. The interaction of the clip members, abutment members in securing to the apertures provided in the lower edge portion acts to provide a tamper resistant connection between the base tray and the sleeve member.

The base tray may preferably have a generally quadrilateral shape when seen from above so that the tray wall may be provided by four distinct sections. Each of the tray wall sections may have a generally oblong curve when seen from above. The curvature of the tray wall sections help to hide the effect of bulging of any soft goods accommodated within the packaging container.

The sleeve member may be formed from an elongate sheet of material wherein the apertures are provided along one of the elongate edges of the sheet member. The opposing edge of the sheet member may define the upper opening of the container when the sleeve member is secured to the base tray. This opposing edge may be shaped to match the product images and branding provided on the outside of the sleeve member. This shaping may involve cutting of the opposing edge in an irregular curve for this purpose. According to a preferred embodiment, the shape of the opposing edge on one half of the sleeve member may be identical to the shape of the opposing edge on a second half of the sleeve member such that there is a substantial symmetry between the two said halves. The advantage of this arrangement is that it allows the same graphic and branding material to be applied to opposing sides of the finished packaging container. This increases the flexibility of the placement of the container within a store as the same product information can be provided on both sides of the container.

The packaging container may preferably include a central support extending above the outer opening of the packaging container and secured to the base wall of the bottom tray. The product can be retained in position within the packaging container by the central support with a portion of the product located within the volume of the packaging container, and another portion of the product remaining exposed when accommodated therein. The central support may include at least two support panels extending generally perpendicularly from the base wall. Each of the support panels may have an upper end that are respectively joined together, and a lower end of each support panel may be secured to the base wall.

The central support may be formed from a folded length of planar material, the fold lines defining the two support panels, an upper joining panel for joining the upper end of the support panels, and a lower engagement arrangement respectively located at the opposing lower free ends of the two support panels. The lower engagement arrangement may include at least one tab member respectively located at each lower free end of the support panels, and slots located within the base wall to accommodate and allow the tab members to pass through the base wall. Each tab member can then be folded over to rest against a bottom face of the base wall and secured in place to prevent easy removal of the support panels therefrom.

A tamperproof assembly may be used to prevent release of the lower engagement arrangement until after the product is purchased. This tamperproof assembly may include an opening provided through each tab member. A eye loop may be provided at the bottom face of the base wall for each tab member, such that when the tab member is folded over the base wall, the eye loop is located to pass though the tab member aperture. A ring tie or other fastening member may then be passed through the eye loop thereby preventing easy separation of the tab member away from the base wall, and providing tamper evidence should unauthorised removal be attempted.

The use of alternative tamperproof assemblies is also envisaged. For example, an adhesive label may be applied over the tab members after they have been folded against the base wall.

The bottom tray may preferably be formed as a unitary moulded shell, and may preferably be made from a plastic material. The sleeve member and central support may be made from cardboard or plastic.

The central support may be made from cardboard. It is however also envisaged that the material such as plastic sheeting be used for the central support.

Preferably one or more products may be packaged within the packaging container with the or each product being wrapped around or otherwise secured by a fabric tie or clip or by other means to at least one of the support panels of the central support.

The products to be packed within the packaging container according to the present invention may include car seat covers. An accommodating space may be provided between the two support panels of the central support to allow accommodation of a further product, for example, a steering wheel cover.

The packaging container according to the present invention allows for a portion of the packaged product to be exposed so that customers can touch the product without having to open the packaging container. The product is also supported in a highly visible manner within the packaging container which can be self standing. The packaging container can however also be used to package other products such as bed linen, table cloths and so on.

BRIEF DESCRIPTION OF THE DRAWINGS

It will be convenient to further describe the invention with reference to the accompanying drawings which illustrate a preferred embodiment of the present invention. Other embodiments are envisaged, and consequently, the particularity of the accompanying drawings is not to be understood as superseding the generality of the preceding description of the invention.

In the drawings.

DETAILED DESCRIPTION OF THE INVENTION

Figure 3:
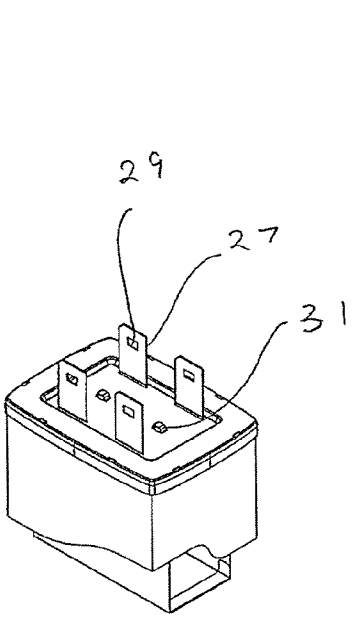
FIG. 3 is a lower perspective view of a packaging container of FIG. 1 shown in a substantially assembled state.
Figure 2:
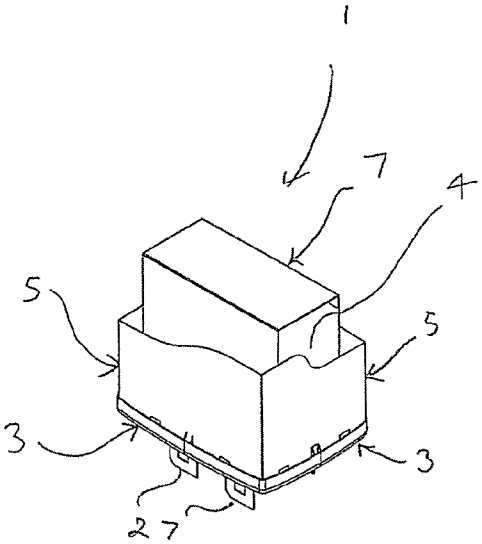
FIG. 2 is a upper perspective view of the packaging container of FIG. 1 shown in an assembled state.
Figure 1:
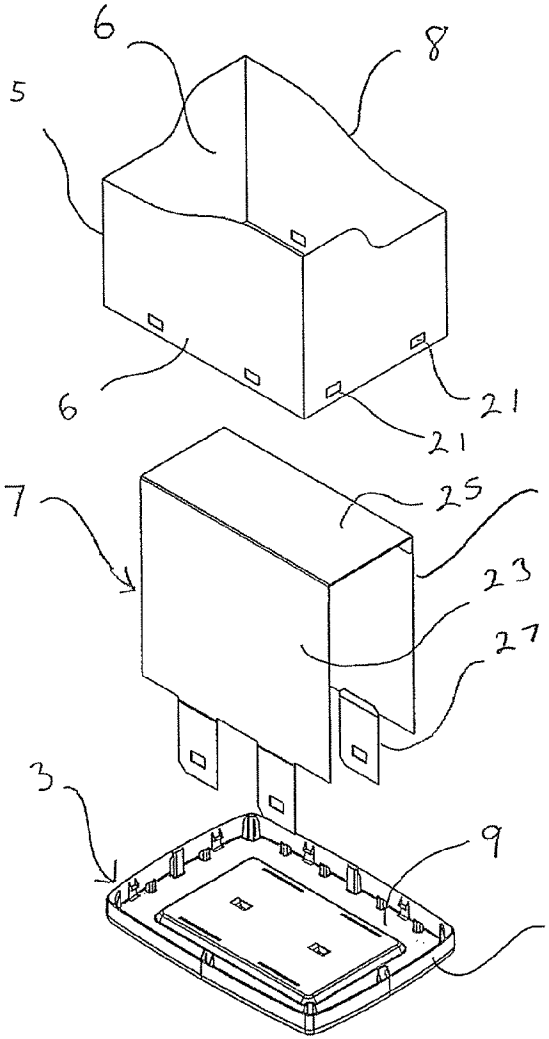
FIG. 1 is an exploded view of a packaging container according to the present invention.

Referring initially to FIGS. 1 to 3, the packaging container 1 according to the present invention includes a bottom tray 3 and a sleeve member 5, which when assembled together define a volume 4 having an upper opening 6 for the container 1. Accommodated within that volume 4 is a central support 7 which provides a support for one or more folded car seat covers (not shown) when packaged within the container 1.

Figure 4:
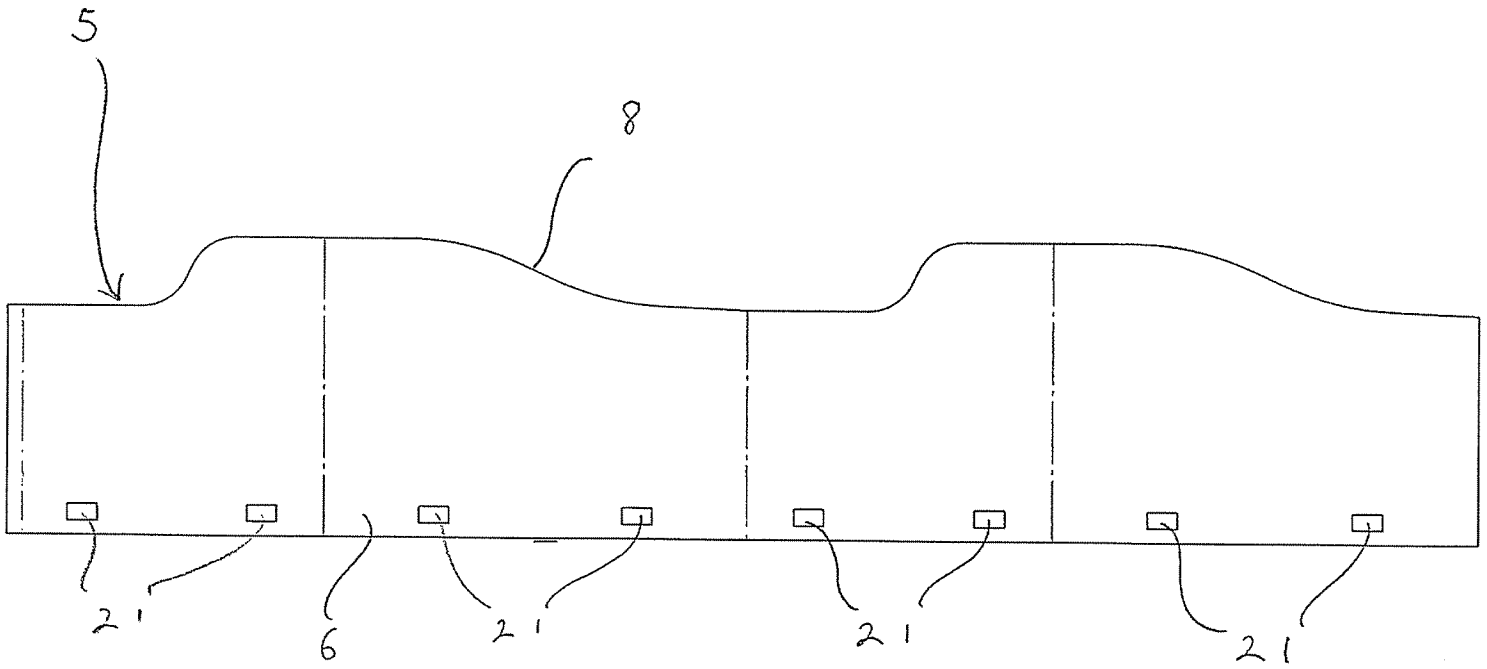
FIG. 4 is a view of a sleeve member of the packaging container of FIG. 1 shown in an unfolded state.
Figure 5C:
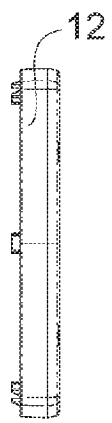
FIGS. 5*a*-5*e* show, respectively, bottom, plan, right side, front side and perspective views of the bottom tray of the packaging container FIG. 1.
Figure 5B:
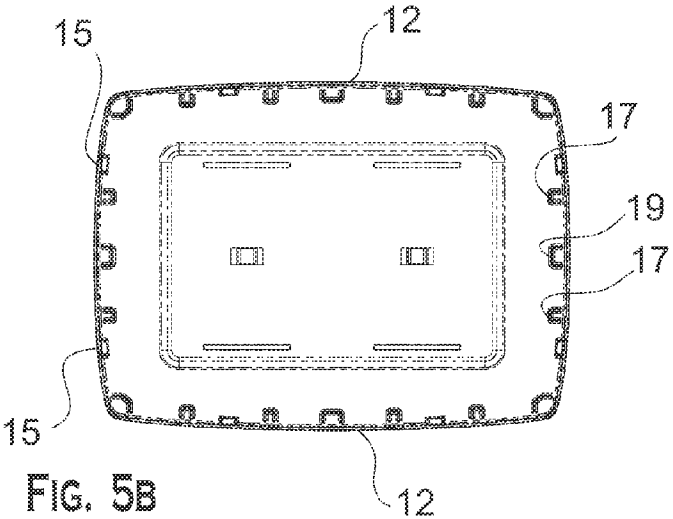
Figure 5D:
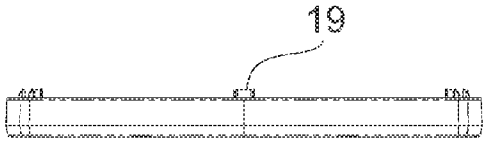
Figure 5A:
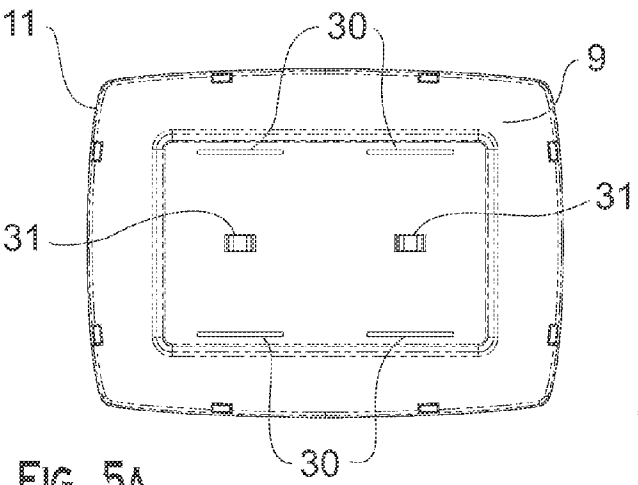
Figure 5E:
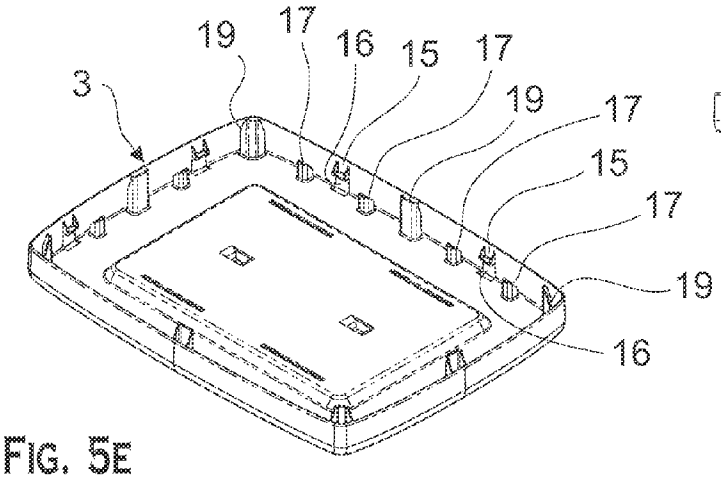

As best shown in FIG. 4, the sleeve member 5 is formed from an elongate sheet of material which is subsequently folded to form the final sleeve member 5. Along one elongate side of the sleeve member 5 which eventually forms a lower edge portion 6 of the sleeve member 5 is provided a series of apertures 21 spaced along the lower edge portion 6. The opposing elongate edge 8 is pre-cut with an irregular curve 8, the curve 8 provided on one half of the sleeve member 5 however being the same as the curve 8 provided on the adjacent half of the sleeve member 5 such that there is a substantial symmetry between the two halves of the sheet member 5. Product images and information can be printed on the sleeve member 5, and this symmetry allows the same information to be printed on both halves of the sleeve member 5. This leads to practical advantages in product placement within a retail outlet, as the same information is displayed regardless of the position of the container 1.

As best shown in FIGS. 5*a*-5*e*, the bottom tray 3 includes a base wall 9, and a tray wall 11 extending along a periphery of the base wall 9. Located along an inner face of the tray wall 11 are series of clip member 15, each clip member 15 having a shoulder 16. These clip members 15 are formed integrally as a part of the bottom tray 3. Extending from the base wall 9 are provided short abutment members 17, and tall abutment members 19 which extend above the height of the tray wall 11. These abutment members 17, 19 are located in close proximity to clip members 15. Each abutment member 17, 19 has an inclined surface 18, 20 at an upper end thereof.

The clip members 15 and abutment member 17, 19 work together to secure the sleeve member 5 to the bottom tray 3. When the lower edge portion 6 of the sleeve member 5 is aligned with the tray wall 11, the shoulder 16 of each clip member 15 respectively engage a cooperating aperture 21 provided on the lower end portion 6. The abutment means 17, 19 acts to direct and urge the lower edge portion 6 towards the clip members 15 so that the shoulders 16 respectively engage the apertures 21 on the lower edge portion 6. The tall abutment members 19 assist to initially guide the sleeve member 5 and correctly locate the lower edge portion 6 thereof relative to the bottom tray 3. The abutment members 17, 19 then act to maintain the lower edge portion 6 in engagement with the clip members 15 to thereby provide a tamper resistant connection between the base tray 3 and the sleeve member 5.

The bottom tray 3 is generally quadrilateral in shape when seen in plan view, and will therefore have four distinct tray wall sections 12. Each wall section 12 has a generally oblong curve when seen in plan view. This curve acts to hide the effect of bulging of any products accommodated within the assembled container 1.

The central support 7 is formed from a folded sheet of material to thereby provide two support panels 23. The two support panels 23 are joined at their upper ends by an upper joining panel 25. Each support panel 23 is provide with a lower engagement arrangement at their lower ends to allow the central support 7 to be attached to the base tray 3. The lower engagement arrangement includes one or more tab members 27 located at the lower end of each support panel 23, an cooperating slots 30 located within the base wall 9. The tab members 27 can be passed through the slots 30, and can then be folded over to rest against the bottom face of the base wall 9. An opening 29 can be provided within each tab member 27, a cooperating eye loops 31 are provided extending from the bottom face of the base wall 9. These eye loops 31 are positioned to pass through a respective tab member opening 29 when the tab member 27 is folded over. A ring tie (not shown) or other fastening means can then be passed through the eye loop 31 to hold the tab member 29, and therefore the central support 7, in place. This provides a further tamper evident arrangement showing any unauthorised opening of the packaging container 1.

Car seat covers and other car accessories can be supported within the container 1 by the central support 7. For example, the car seat covers can be wrapped around the support panels 23 and held in place by fabric ties or clips. Other car accessories such as a steering wheel cover can for example be held within the space provided between the two support panels 23.

Modifications and variations as would be deemed obvious to the person skilled in the art are included within the ambit of the present invention as claimed in the appended claims.

The claims defining the invention are as follows:

1. A packaging container for a product, comprising:

a bottom tray including a base wall and a tray wall extending around the periphery of the base wall;

a sleeve member supported on the bottom tray and extending along the periphery of the base wall such that the bottom tray and sleeve member together define a volume having an upper opening for accommodating the product, the sleeve member having a lower edge portion secured to the bottom tray by a securing arrangement;

wherein the securing arrangement includes a plurality apertures provided in the lower edge portion of the sleeve member, a plurality of clip members located along an inner face of the tray wall, each clip member including a shoulder for engaging a respective aperture, and a plurality of abutment members located adjacent the clip members for abutting the lower edge portion of the sleeve member and maintaining the lower edge portion in an engaged position with the clip members, wherein at least one of the abutment members extends beyond an upper edge of the tray wall.

2. A packaging container for a product, comprising:

a bottom tray including a base wall and a tray wall extending around the periphery of the base wall;

a sleeve member supported on the bottom tray and extending along the periphery of the base wall such that the bottom tray and sleeve member together define a volume having an upper opening for accommodating the product, the sleeve member having a lower edge portion secured to the bottom tray by a securing arrangement;

wherein the securing arrangement includes at least one aperture provided in the lower edge portion of the sleeve member, at least one clip member located along an inner face of the tray wall, the clip member including a shoulder for engaging the at least one aperture, and at least one abutment member located adjacent the at least one clip member for abutting the lower edge portion of the sleeve member and maintaining the lower edge portion in an engaged position with the at least one clip member, and wherein the base tray has a generally quadrilateral shape so as to define four distinct tray wall sections of the tray wall, each of the tray wall sections having a generally oblong curve.

3. A packaging container for a product, comprising:

a bottom tray including a base wall and a tray wall extending around the periphery of the base wall;

a sleeve member supported on the bottom tray and extending along the periphery of the base wall such that the bottom tray and sleeve member together define a volume having an upper opening for accommodating the product, the sleeve member having a lower edge portion secured to the bottom tray by a securing arrangement; and a central support secured to the base wall and extending through the upper opening of the volume and above an upper edge of the sleeve member, wherein the sleeve member surrounds the central support and is spaced outwardly from the central support on all sides thereof;

wherein the securing arrangement securing the sleeve member to the bottom tray includes at least one aperture provided in the lower edge portion of the sleeve member, at least one clip member located along an inner face of the tray wall, the clip member including a shoulder for engaging the at least one aperture, and at least one abutment member located adjacent the at least one clip member for abutting the lower edge portion of the sleeve member and maintaining the lower edge portion in an engaged position with the at least one clip member.

4. The packaging container according to claim 3, wherein the at least one clip member includes a plurality of clip members, the at least one aperture includes a plurality of apertures, and the at least one abutment member includes a plurality of abutment members, the clip members being spaced along the inner face of the tray wall for respectively engaging the apertures provided and spaced along the lower edge portion of the sleeve member, and the abutment members being provided adjacent to respective clip members.

5. The packaging container according to claim 3, wherein the clip member is formed as part of the tray wall, and wherein the abutment member is formed as part of the base wall and extends upwardly therefrom.

6. The packaging container according to claim 3, wherein the abutment member has an upper free end having an inclined surface facing the tray wall for urging the lower edge portion of the sleeve member towards the tray wall.

7. The packaging container according to claim 3, wherein the sleeve member is formed from an elongate sheet of material, the at least one aperture being provided along one of the elongate edges of the sleeve member, the opposing edge of the sleeve member defining the upper opening of the packaging container when the sleeve member is secured to the base tray.

8. The packaging container according to claim 7, wherein the opposing edge of the sleeve member has an irregular shape, the shape of the opposing edge on one half of the sleeve member being identical to the shape of the opposing edge on a second half of the sleeve member.

9. The packaging container according to claim 3, wherein the central support includes at least two support panels extending generally perpendicularly from the base wall, the support panels having upper ends that are joined together, with a lower end of each support panel being secured to the base wall.

10. The packaging container according to claim 9, further comprising:

a lower engagement arrangement located at the lower ends of the two support panels, the lower engagement arrangement including at least one tab member respectively located at each lower end of the support panels, and slots located within the base wall to accommodate and allow the tab members to pass through the base wall.

11. The packaging container according to claim 10, wherein the lower engagement arrangement includes an opening provided through each tab member, and the bottom tray includes an eye loop at the bottom face of the base wall, the eye loop passing through the tab member opening when the tab member is folded over the base wall, so that a ring tie can be passed though the eye loop to thereby provide a tamper evident assembly.

12. The packaging container according to claim 3, wherein the bottom tray is formed as a unitary molded shell.

13. The packaging container according to claim 3, wherein the sleeve member is made from cardboard or a plastic material.

14. The packaging container for packaging a product according to claim 3, wherein the product includes at least one car seat cover.

15. The packaging container for packaging a product according to claim 3, wherein the product includes at least one soft good.

* * * * *